US009157396B2

(12) United States Patent
Lusardi et al.

(10) Patent No.: US 9,157,396 B2
(45) Date of Patent: Oct. 13, 2015

(54) NOZZLED TURBINE

(71) Applicant: Caterpillar Inc., Peoria, IL (US)

(72) Inventors: Christopher Lusardi, Peoria, IL (US); Richard W. Kruiswyk, Dunlap, IL (US); Kerry A. Delvecchio, Dunlap, IL (US); Matthew T. Wolk, Peoria, IL (US); Rohan Swar, Peoria, IL (US); Carl-Anders Hergart, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 131 days.

(21) Appl. No.: 13/896,488

(22) Filed: May 17, 2013

(65) Prior Publication Data

US 2014/0338328 A1 Nov. 20, 2014

(51) Int. Cl.

| | |
|---|---|
| ***F02D 23/00*** | (2006.01) |
| ***F02B 33/44*** | (2006.01) |
| ***F01D 1/02*** | (2006.01) |
| ***F02M 25/07*** | (2006.01) |
| ***F01D 9/04*** | (2006.01) |
| ***F01D 9/02*** | (2006.01) |

(52) U.S. Cl.

CPC ..... *F02M 25/0707* (2013.01); *F01D 9/026* (2013.01); *F01D 9/04* (2013.01); *F01D 9/045* (2013.01); *F01D 9/047* (2013.01)

(58) Field of Classification Search

CPC ..... F02B 37/00; F01D 9/026; F01D 9/045; F01D 9/04

USPC ..... 60/602, 605.2; 415/159, 185–187, 191, 415/193–194, 208.2–208.5, 211.1

See application file for complete search history.

(56) References Cited

U.S. PATENT DOCUMENTS

| | | | | |
|---|---|---|---|---|
| 6,672,061 | B2 | 1/2004 | Schmit et al. | |
| 6,709,235 | B2 | 3/2004 | Hosny | |
| 6,715,288 | B1 | 4/2004 | Engels et al. | |
| 7,269,950 | B2 | 9/2007 | Pedersen et al. | |
| 7,428,814 | B2 * | 9/2008 | Pedersen et al. | 60/602 |
| 7,523,736 | B2 | 4/2009 | Rammer et al. | |
| 7,828,517 | B2 | 11/2010 | Serres | |
| 7,934,379 | B2 | 5/2011 | Küspert et al. | |

(Continued)

FOREIGN PATENT DOCUMENTS

| | | |
|---|---|---|
| DE | 10 2008 060 943 A1 | 6/2010 |
| WO | WO 02/270164 | 4/2002 |

OTHER PUBLICATIONS

European Patent Office, International Search Report in International Patent Application No. PCT/US2014/036649, Aug. 1, 2014, 3 pp.

(Continued)

*Primary Examiner* — Thai Ba Trieu
*Assistant Examiner* — Ngoc T Nguyen
(74) *Attorney, Agent, or Firm* — Leydig, Voit & Mayer, Ltd.

(57) ABSTRACT

A turbine includes a turbine housing having two gas passages of substantially the same flow area. A nozzle ring is disposed in the housing and around the turbine wheel. The nozzle ring includes first and second outer rings, and an inner ring disposed between the first and second outer rings. First and second pluralities of vanes are disposed between the rings. The second outer ring has a thicker cross section than the first outer ring such that a larger flow area is created between the first outer ring and the inner ring than a flow area created between the second outer ring and the inner ring.

23 Claims, 6 Drawing Sheets

(56) References Cited

U.S. PATENT DOCUMENTS

| | | | | |
|---|---|---|---|---|
| 8,123,470 | B2 * | 2/2012 | Serres et al. | 415/159 |
| 8,128,356 | B2 | 3/2012 | Higashimori | |
| 2003/0026692 | A1 * | 2/2003 | Lutz | 415/158 |
| 2007/0089415 | A1 | 4/2007 | Shimokawa et al. | |
| 2007/0175214 | A1 * | 8/2007 | Reisdorf et al. | 60/605.1 |
| 2007/0209361 | A1 * | 9/2007 | Pedersen et al. | 60/602 |
| 2007/0267002 | A1 | 11/2007 | Schmid et al. | |
| 2009/0041577 | A1 * | 2/2009 | Serres | 415/159 |
| 2011/0110766 | A1 * | 5/2011 | Moore et al. | 415/158 |
| 2012/0023936 | A1 * | 2/2012 | Kruiswyk et al. | 60/605.2 |
| 2013/0000300 | A1 * | 1/2013 | O'Hara | 60/605.2 |
| 2014/0140834 | A1 * | 5/2014 | Richner et al. | 415/191 |

OTHER PUBLICATIONS

European Patent Office, Written Opinion in International Patent Application No. PCT/US2014/036649, Aug. 1, 2014, 5 pp.

* cited by examiner

NOZZLED TURBINE

TECHNICAL FIELD

This patent disclosure relates generally to turbocharger turbines and, more particularly, to turbocharger turbines used on internal combustion engines.

BACKGROUND

Internal combustion engines are supplied with a mixture of air and fuel for combustion within the engine that generates mechanical power. To maximize the power generated by this combustion process, the engine is often equipped with a turbocharged air induction system.

A turbocharged air induction system includes a turbocharger having a turbine that uses exhaust from the engine to compress air flowing into the engine, thereby forcing more air into a combustion chamber of the engine than a naturally aspirated engine could otherwise draw into the combustion chamber. This increased supply of air allows for increased fuelling, resulting in an increased engine power output.

The fuel energy conversion efficiency of an engine depends on many factors, including the efficiency of the engine's turbocharger. Previously proposed turbocharger designs include turbines having separate gas passages formed in their housings. In such turbines, two or more gas passages may be formed in the turbine housing and extend in parallel to one another such that exhaust pulse energy fluctuations from individual engine cylinders firing at different times are preserved as the exhaust gas passes through an exhaust collector or manifold to the turbine. These exhaust pulses can be used to improve the driving function of the turbine and increase the efficiency of the exhaust system.

Internal combustion engines also use various systems to reduce certain compounds and substances that are byproducts of the engine's combustion. One such system, which is commonly known as exhaust gas recirculation (EGR), is configured to recirculate metered and often cooled exhaust gas into the intake system of the engine. The combustion gases recirculated in this fashion have considerably lower oxygen concentration than the fresh incoming air. The introduction of recirculated gas in the intake system of an engine and its subsequent introduction in the engine cylinders results in lower combustion temperatures being generated in the engine, which in turn reduces the creation of certain combustion byproducts, such as compounds containing oxygen and nitrogen.

One known configuration for an EGR system used on turbocharged engines is commonly referred to as a high pressure EGR system. The high pressure designation is based on the locations in the engine intake and exhaust systems between which exhaust gas is recirculated. In a high pressure EGR system (HP-EGR), exhaust gas is removed from the exhaust system from a location upstream of a turbine and is delivered to the intake system at a location downstream of a compressor. After being introduced into the intake system, the recirculated exhaust gas mixes with fuel and fresh air from the compressor to form a mixture that is then combusted in each engine cylinder.

In engines lacking specialized components, such as pumps, that promote the flow of EGR gas between the exhaust and intake systems of the engine, the maximum possible flow rate of EGR gas through the EGR system will depend on the pressure difference between the exhaust and intake systems of the engine. This pressure difference is commonly referred to as the EGR driving pressure. It is often the case that engines require a higher flow of EGR gas than what is possible based on the EGR driving pressure present during engine operation.

In the past, various solutions have been proposed to selectively adjust the EGR driving pressure in turbocharged engines. One such solution has been the use of variable nozzle or variable geometry turbines. A variable nozzle turbine includes moveable blades disposed around the turbine wheel. Movement of the vanes changes the effective flow rate of the turbine and thus, in one aspect, creates a restriction that increases the pressure of the engine's exhaust system during operation. The increased exhaust gas pressure of the engine results in an increased EGR driving pressure, which in turn facilitates the increased flow capability of EGR gas in the engine.

Although this and other known solutions to increase the EGR gas flow capability of an engine have been successful and have been widely used in the past, they require use of a variable geometry turbine, which is a relatively expensive device that includes moving parts operating in a harsh environment. Moreover, by being unable to separate flows from different sets of cylinders, variable geometry turbines typically destroy or mute the pulse energy of the exhaust gas stream of the engine, which results in lower turbine efficiency and higher fuel consumption. Further, increasing engine exhaust back pressure tends to offset the fuel economy benefits of having a variable turbine geometry.

SUMMARY

In one aspect, the disclosure describes a turbine. The turbine comprises a turbine housing including at least two gas passages having substantially the same flow area and disposed on opposing sides of a divider wall, and a turbine wheel having a plurality of blades. A nozzle ring is connected to the turbine housing and disposed around the turbine wheel. The nozzle ring has a first outer ring and an inner ring disposed adjacent the first outer ring. The inner ring has an annular shape and is disposed in axial alignment with the divider wall. A second outer ring is disposed adjacent the inner ring and has a thicker cross section than the first outer ring. A first plurality of vanes is fixedly disposed between the first outer and the inner rings, and defines a first plurality of inlet openings therebetween that are in fluid communication with a slot formed in the nozzle ring and surrounding the turbine wheel. A second plurality of vanes is fixedly disposed between the second outer and the inner rings and defines a second plurality of inlet openings therebetween that are in fluid communication with the slot. The first plurality of inlet openings collectively defines a first flow area that is larger than a second flow area collectively defined by the second plurality of inlet openings.

In another aspect, the disclosure describes an internal combustion engine. The internal combustion engine includes a divided turbine having first and second inlets. A first plurality of cylinders is connected to a first exhaust conduit, which is connected to the first inlet of the divided turbine. A second plurality of cylinders is connected to a second exhaust conduit, which is connected to the second inlet of the divided turbine. A balance valve is disposed to selectively route exhaust gas from the first exhaust conduit to the second exhaust conduit, and an exhaust gas recirculation (EGR) system includes a valve that selectively and fluidly connects the first exhaust conduit with an intake system of the engine.

In one embodiment, the divided turbine comprises a turbine housing including two gas passages having substantially the same flow area and disposed on opposing sides of a divider wall. The two gas passages are fluidly connected to the first and second inlets of the divided turbine. A turbine wheel has a plurality of blades, and a nozzle ring is connected to the turbine housing and disposed around the turbine wheel. The nozzle ring includes a first outer ring and an inner ring disposed adjacent the first outer ring. The inner ring has an annular shape and is disposed in axial alignment with the divider wall. A second outer ring is disposed adjacent the inner ring. The second outer ring has a thicker cross section than the first outer ring. A first plurality of vanes is fixedly disposed between the first outer ring and the inner ring, and defines a first plurality of inlet openings therebetween that are in fluid communication with a slot formed in the nozzle ring and surrounding the turbine wheel. A second plurality of vanes is fixedly disposed between the second outer and the inner rings. The second plurality of vanes defines a second plurality of inlet openings, each opening defined between two adjacent vanes. The second plurality of inlet openings are in fluid communication with the slot. The first plurality of inlet openings collectively defines a first flow area that is larger than a second flow area collectively defined by the second plurality of inlet openings.

In yet another aspect, the disclosure describes a nozzle ring adapted for installation into a receiving bore formed in a turbine housing. The turbine housing has two flow passages having substantially the same flow area formed therewithin and separated by a divider wall, each flow passage being connected to a respective gas inlet, the receiving bore surrounding a turbine wheel when the turbine housing is assembled into a turbocharger. The nozzle ring comprises a first outer ring, an inner ring disposed adjacent the first outer ring, said inner ring having an annular shape and disposed in axial alignment with the divider wall, and a second outer ring disposed adjacent the inner ring, said second outer ring having a thicker cross section than the first outer ring. A first plurality of vanes is fixedly disposed between the first outer ring and the inner ring. The first plurality of vanes defines a first plurality of inlet openings therebetween that are in fluid communication with a slot formed in the nozzle ring and adapted to surround the turbine wheel. A second plurality of vanes is fixedly disposed between the second outer and the inner rings and defines a second plurality of inlet openings therebetween that are in fluid communication with the slot. The first plurality of inlet openings collectively defines a first flow area that is larger than a second flow area collectively defined by the second plurality of inlet openings.

DETAILED DESCRIPTION

Figure 1:
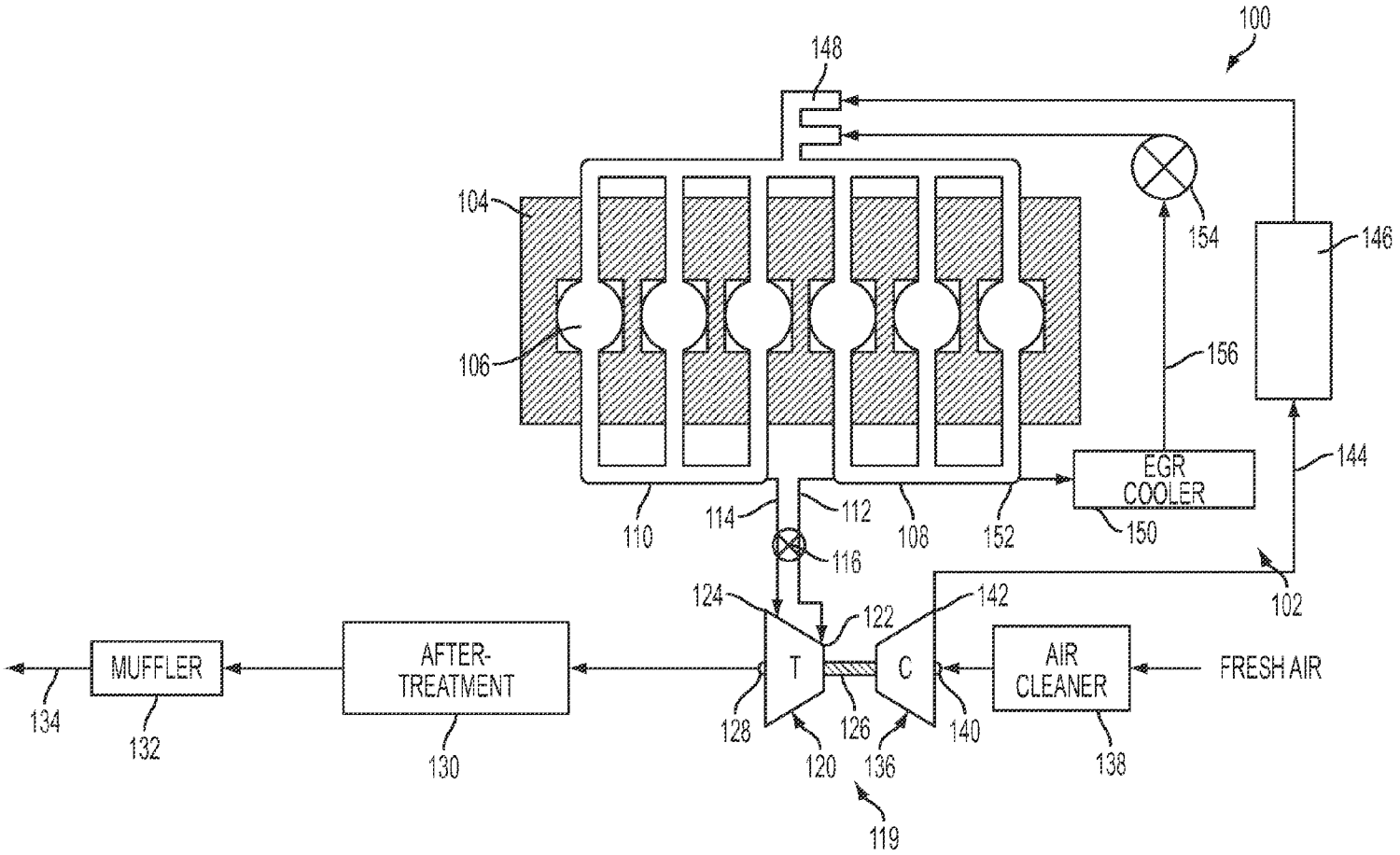
FIG. 1 is a block diagram of an internal combustion engine having a high pressure EGR system in accordance with the disclosure.

This disclosure relates to an improved turbine configuration used in conjunction with a turbocharger in an internal combustion engine to promote the engine's efficiency and ability to drive sufficient amounts of EGR gas. A simplified block diagram of an engine 100 having a high pressure EGR system 102 is shown in FIG. 1. The engine 100 includes a crankcase 104 that houses a plurality of combustion cylinders 106. In the illustrated embodiment, six combustion cylinders are shown in an inline or "I" configuration, but any other number of cylinders arranged in a different configuration, such as a "V" configuration, may be used. The plurality of cylinders 106 is fluidly connected via exhaust valves (not shown) to first and second exhaust conduits 108 and 110. Each of the first and second exhaust conduits 108 and 110 is connected to a respective exhaust pipe 112 and 114, which are in turn connected to a turbine 120 of a turbocharger 119. A balance valve 116 is fluidly interconnected between the two exhaust pipes 112 and 114 and is arranged to route exhaust gas from the first exhaust pipe 112 to the second exhaust pipe 114, as necessary, during operation. It is noted that the balance valve 116 is optional and may be omitted.

In the illustrated embodiment, the turbine 120 has a separated housing, which includes a first inlet 122 fluidly connected to the first exhaust pipe 112, and a second inlet 124 connected to the second exhaust pipe 114. Each inlet 122 and 124 is disposed to receive exhaust gas from one or both of the first and second exhaust conduits 108 and 110 during engine operation. The exhaust gas causes a turbine wheel (not shown here) connected to a shaft 126 to rotate before exiting the housing of the turbine 120 through an outlet 128. The exhaust gas at the outlet 128 is optionally passed through other exhaust components, such as an after-treatment device 130 that mechanically and chemically removes combustion byproducts from the exhaust gas stream, and/or a muffler 132 that dampens engine noise, before being expelled to the environment through a stack or tail pipe 134.

Rotation of the shaft 126 causes the wheel (not shown here) of a compressor 136 to rotate. As shown, the compressor 136 is a radial compressor configured to receive a flow of fresh, filtered air from an air filter 138 through a compressor inlet 140. Pressurized air at an outlet 142 of the compressor 136 is routed via a charge air conduit 144 to a charge air cooler 146 before being provided to an intake manifold 148 of the engine 100. In the illustrated embodiment, air from the intake manifold 148 is routed to the individual cylinders 106 where it is mixed with fuel and combusted to produce engine power.

The EGR system 102 includes an optional EGR cooler 150 that is fluidly connected to an EGR gas supply port 152 of the first exhaust conduit 108. A flow of exhaust gas from the first exhaust conduit 108 can pass through the EGR cooler 150 where it is cooled before being supplied to an EGR valve 154 via an EGR conduit 156. The EGR valve 154 may be electronically controlled and configured to meter or control the flow rate of the gas passing through the EGR conduit 156. An outlet of the EGR valve 154 is fluidly connected to the intake manifold 148 such that exhaust gas from the EGR conduit 156 may mix with compressed air from the charge air cooler 146 within the intake manifold 148 of the engine 100.

The pressure of exhaust gas at the first exhaust conduit 108, which is commonly referred to as back pressure, is higher than ambient pressure, in part, because of the flow restriction presented by the turbine 120. For the same reason, a positive back pressure is present in the second exhaust conduit 110. The pressure of the air or the air/EGR gas mixture in the intake manifold 148, which is commonly referred to as boost pressure, is also higher than ambient because of the compression provided by the compressor 136. In large part, the pressure difference between back pressure and boost pressure, coupled with the flow restriction and flow area of the components of the EGR system 102, determine the maximum flow rate of EGR gas that may be achieved at various engine operating conditions.

For this reason, the back pressure at the first exhaust conduit 108 is maintained at a higher level than the back pressure at the second exhaust conduit 110 at times during engine operation when additional EGR driving pressure is desired. To accomplish this pressure increase, the turbine 120 is configured to have different exhaust gas flow restriction characteristics, with the flow entering through the first inlet 122 being subject to a higher flow restriction than the flow entering through the second inlet 124. This different or asymmetrical flow restriction characteristic of the turbine 120 provides an increased pressure difference to drive EGR gas without increasing the back pressure of substantially all cylinders 106 of the engine 100. At times when no back pressure increase is desired in the first exhaust conduit 108 to drive EGR gas flow, the optional balance valve 116 may be used to balance out the exhaust flow through each of the two inlets 122 and 124 of the turbine 120.

Figure 2:
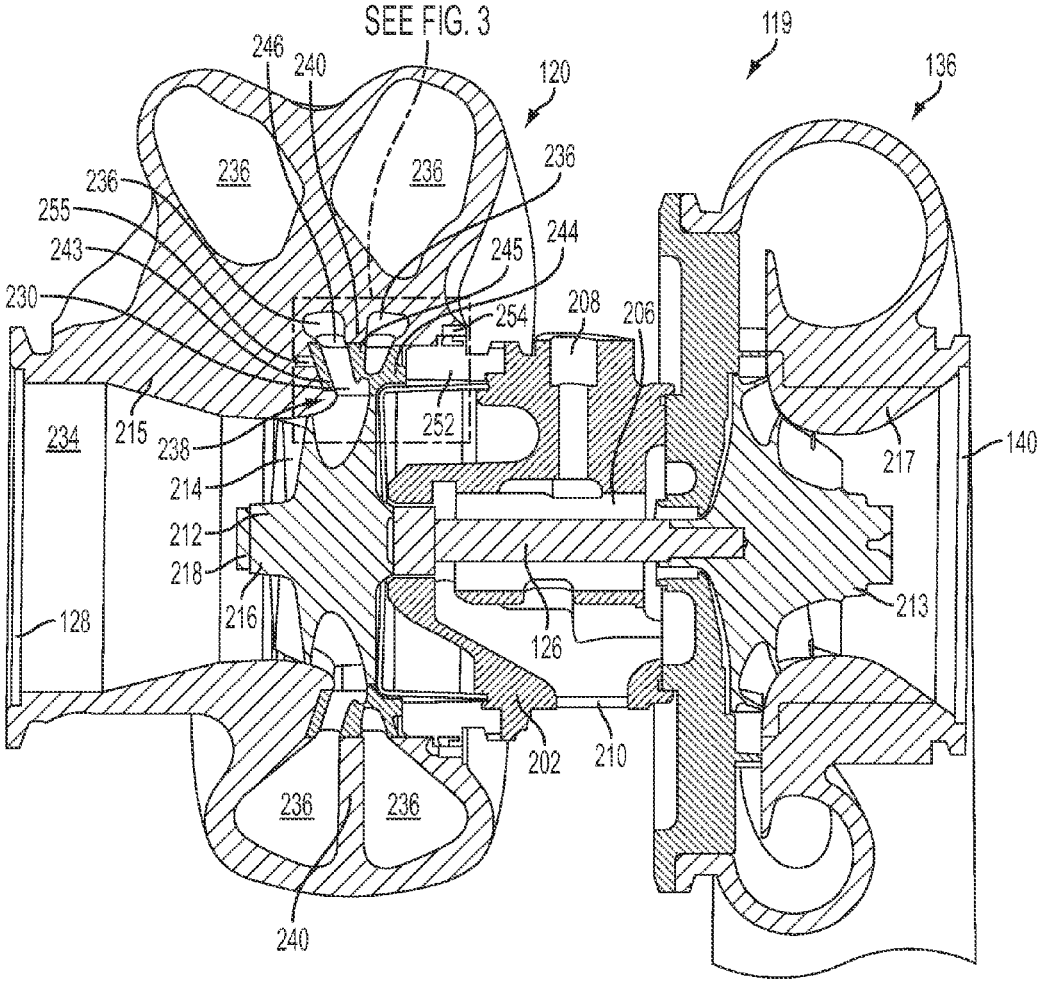
FIG. 2 is a section of a turbocharger assembly in accordance with the disclosure.

In the description that follows, structures and features that are the same or similar to corresponding structures and features already described are denoted by the same reference numerals as previously used for simplicity. Accordingly, a partial cross section of one embodiment of the turbine 120 is shown in FIG. 2. The turbine 120 is connected to a center housing 202. As shown, the center housing 202 surrounds a portion of the shaft 126 and includes a bearing (not shown) disposed within a lubrication cavity 206. The lubrication cavity 206 includes lubricant inlet and outlet openings that accommodate a flow of lubrication fluid therethrough to lubricate the bearing as the shaft 126 rotates during operation.

The shaft 126 is connected to a turbine wheel 212 at one end and to a compressor wheel 213 at another end. The turbine wheel 212 is configured to rotate within a turbine housing 215 that is connected to the center housing 202. The compressor wheel 213 is disposed to rotate within a compressor housing 217. The turbine wheel 212 includes a plurality of blades 214 radially arranged around a hub 216. The hub 216 is connected to an end of the shaft 126 by a fastener 218 and is configured to rotate the shaft 126 during operation. The turbine wheel 212 is rotatably disposed between an exhaust gas inlet slot 230 defined within the turbine housing 215. The slot 230 provides exhaust gas to the turbine wheel 212 in a generally radially inward direction relative to the shaft 126 and the blades 214. Exhaust gas exiting the turbine wheel 212 is provided to a turbine outlet bore 234 that is fluidly connected to the turbine outlet 128. The gas inlet slot 230 is fluidly connected to inlet gas passages 236 formed in the turbine housing 215 and configured to fluidly interconnect the gas inlet slot 230 with the turbine inlets 122 and 124 (FIG. 1).

Each of the two turbine inlets 122 and 124 is connected to one of two inlet gas passages 236. Each gas passage 236 has a generally scroll shape that is wrapped around the area of the turbine wheel 212 and bore 234 and is open to the slot 230 around the entire periphery of the turbine wheel 212. The cross sectional flow area of each passage 236 decreases along a flow path of gas entering the turbine 120 via the inlets 122 and 124 and exiting the housing through the slot 230. As shown, the two passages 236 have substantially the same cross sectional flow area at any given radial location around the wheel 212. Although two passages 236 are shown, a single passage or more than two passages may be used.

A radial nozzle ring 238 is disposed substantially around the entire periphery of the turbine wheel 212. As will be discussed in more detail in the paragraphs that follow, the radial nozzle ring 238 is disposed in fluid communication with both passages 236 and defines the slot 230 around the wheel 212. As shown in FIG. 2 and in the detailed view of FIG. 3, a divider wall 240 is defined in the housing 215 between the two passages 236. The divider wall 240 is disposed radially outwardly relative to the slot 230 such that gas flow from the two passages 236 may be combined before entering the slot 230 and reaching the wheel.

Figure 3:
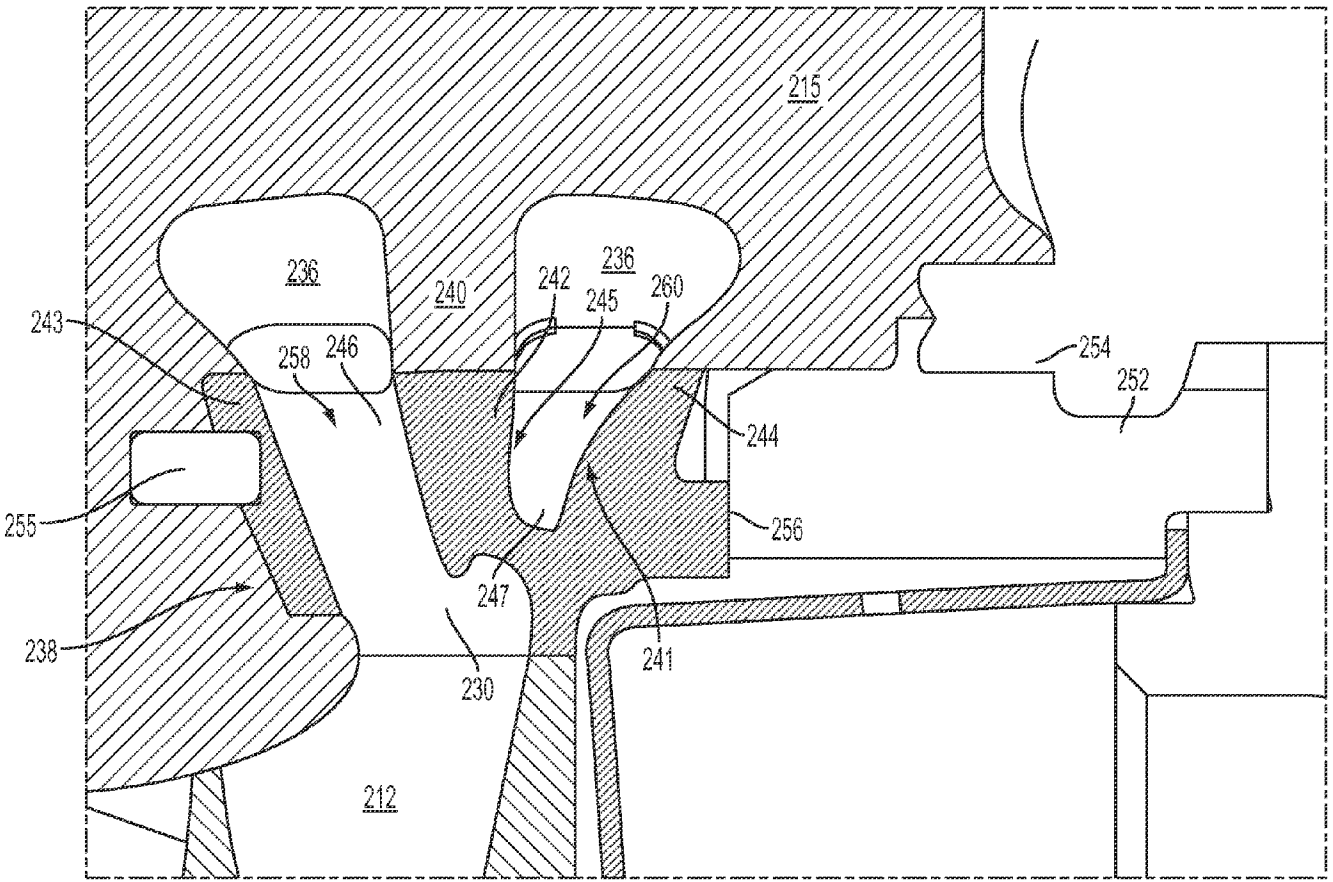
FIG. 3 is a detail section of a turbine assembly in accordance with the disclosure.
Figure 4:
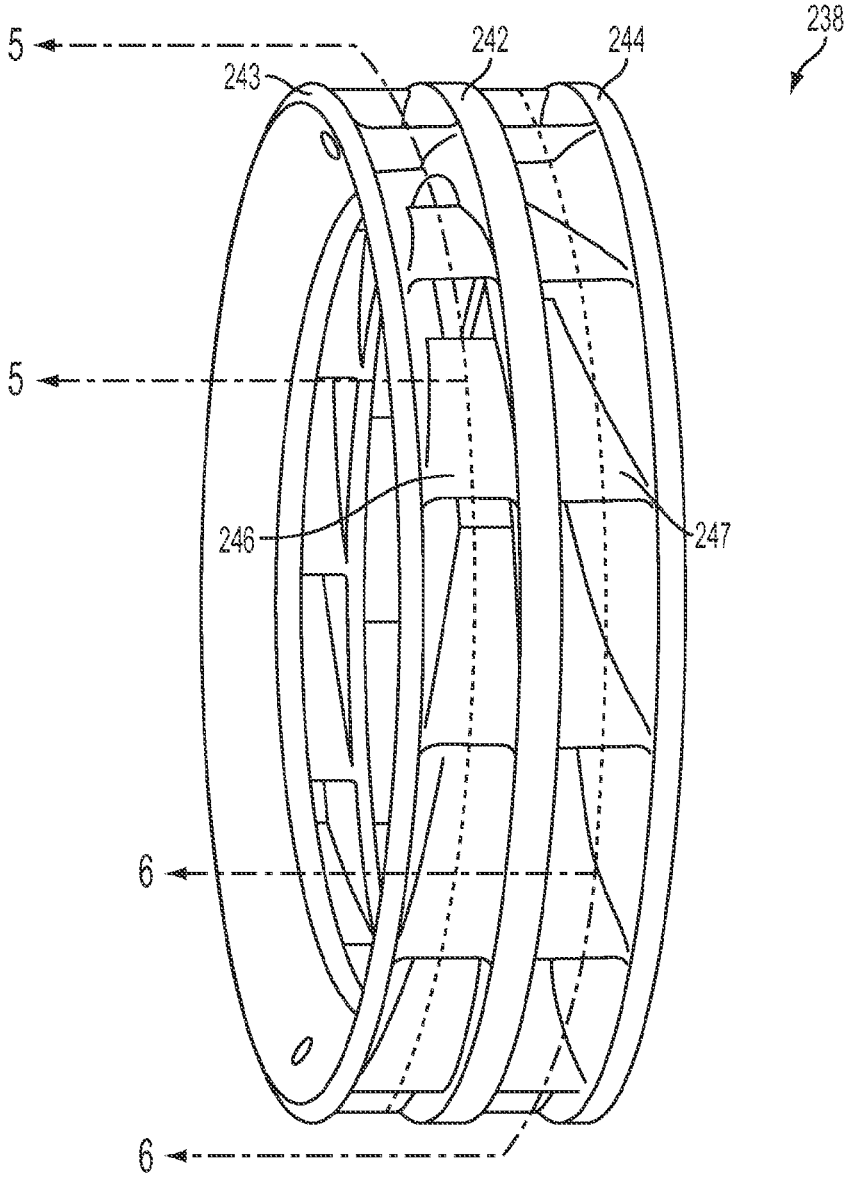
FIG. 4 is an outline view of a radial nozzle ring in accordance with the disclosure.

In further reference to FIG. 4, the nozzle ring 238 includes an inner ring 242 disposed between two outer rings, namely a first outer ring 243 and a second outer ring 244. The inner ring 242 is positioned adjacent the divider wall 240 and forms an extension thereof, as shown in FIG. 3, to form a divider wall extension portion 245. The inner ring 242 is, in this way, axially aligned with the divider wall 240. In the illustrated embodiment, the inner ring 242 has a symmetrical shape that bisects the distance between the radially and axially outermost portions of the two outer rings 243 and 244 into substantially equal parts. The second outer ring 244 has a thicker cross section than the first outer ring 243 so that a reduced gas flow area is defined between the second outer ring 244 and the inner ring 242 than the flow area defined between the first outer ring 243 and the inner ring 242, as shown in FIG. 3. In the illustrated embodiment, the thicker cross section of the second outer ring 244 is created by a bulging portion 241, which is a smooth protrusion of the sidewall of the second outer ring 244 facing the inner ring 242 that encroaches into the cross sectional flow area between the inner ring 242 and the second outer ring 244. A first plurality of vanes 246 is symmetrically disposed between the first outer ring 243 and the inner ring 242, and a second plurality of vanes 247 is disposed between the inner ring 242 and the second outer ring 244.

Figure 5:
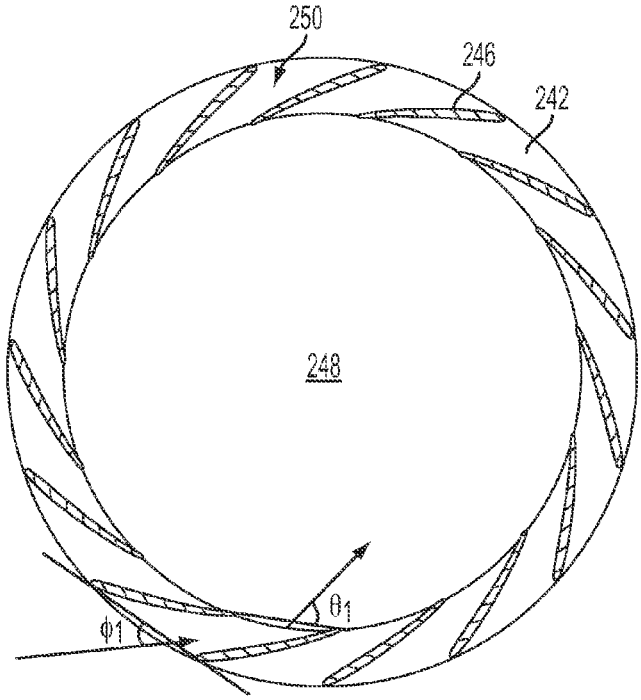
FIG. 5 is a first section of a nozzle ring in accordance with the disclosure.
Figure 6:
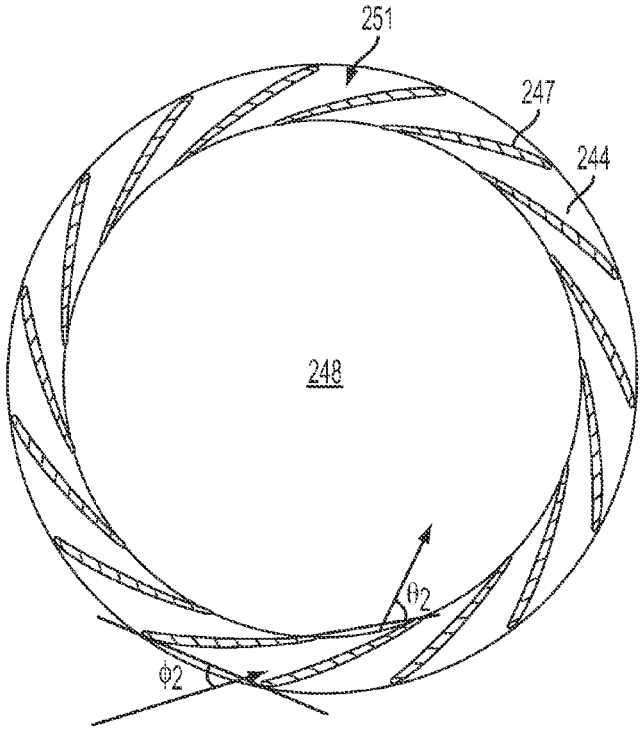
FIG. 6 is a second section of a nozzle ring in accordance with the disclosure.

The shape and configuration of the first and second pluralities of vanes 246 and 247 is different, as can be seen in the cross sections of FIGS. 5 and 6. As shown, both pluralities of vanes 246 and 247 are arranged symmetrically around a central opening 248 of the ring 238, but each of the vanes in the first plurality 246 has a greater angle of attack than each of the vanes in the second plurality 247 relative to the radially inwardly moving exhaust gas. As a result, a first plurality of inclined flow channels 250 is defined between adjacent vanes in the first plurality of vanes 246, and a second plurality of inclined flow channels 251 is defined between adjacent vanes in the second plurality of vanes 247. As between the two flow channel pluralities, those flow channels in the first plurality 250 induce a gas flow into the center opening 248 with a more pronounced radial velocity component than the corresponding radial velocity component of flow provided by the flow channels of the second plurality 251. Moreover, the flow area of each of the flow channels in the first plurality 250 in a radial direction relative to the turbine shaft is larger than the flow area of each of the flow channels in the second plurality 251 in the same direction, which causes a lower flow pressure drop for gas passing through the first plurality of inclined flow channels 250. As shown in FIG. 3, the second outer ring 244 also has a thicker cross section than the first outer ring 243, which means that the cross sectional flow area for gas in the axial direction between the inner ring 242 and the second outer ring 244 is also smaller than the corresponding flow area between the first outer ring 243 and the inner ring 242.

The flow momentum of gas passing through the channels 250 and 251 is directed generally tangentially and radially inward towards an inner diameter of the wheel 212 (shown in FIG. 2) such that wheel rotation may be augmented. Although the vanes 246 and 247 further have a generally curved airfoil shape to minimize flow losses of gas passing over and between the vanes, thus providing respectively uniform inflow conditions to the turbine wheel, they also provide structural support to the inner ring 242. In the illustrated embodiment there are fifteen vanes in each of the first and second pluralities of vanes 246 and 247, each of which is connected on either side of the inner ring 242 and at approximately the same radial locations, but any other number or placement of vanes may be used. For instance, thirteen vanes may be used instead of fifteen. In the illustrated embodiment, the number of vanes 246 and 247 is different than the number of blades 214 of the turbine wheel 212 such that resonance conditions are avoided during operation.

Returning now to FIG. 2, the nozzle ring 238 is disposed within a bore formed in the turbine housing 215. A retainer 252 is disposed to retain the ring 238 within the housing 215. The retainer 252 extends peripherally around the ring 238 and is retained to the housing by one or more fasteners 254. Further, one or more pins 255 disposed in corresponding cavities formed in the housing and in the ring 238 may be used to properly orient the nozzle ring 238 relative to the housing 215 during assembly. The nozzle ring 238 may have a clearance fit with the bore of the housing 215 such that sufficient clearance is provided for thermal growth of each component during operation to minimize thermal stresses.

As shown in FIG. 3, the second outer ring 244 of the nozzle ring 238 defines a contact pad 256 that abuts the retainer 252. The contact pad 256 is disposed to provide axial engagement of the nozzle ring 238 with the housing 215. The illustrated configuration of the nozzle ring 238 includes two pluralities of inlet openings 258 and 260. Each of the first and second pluralities of inlet openings 258 and 260 is defined between adjacent vanes 246 and 247, respectively, the inner ring 242, and the corresponding first or second outer ring 243 or 244. Accordingly, a first plurality of inlet openings 258 is defined between the first outer ring 243, the inner ring 242, and the first plurality of vanes 246; a second plurality of inlet openings 260 is defined between the inner ring 242, the second outer ring 244, and the second plurality of vanes 247. As previously mentioned, the flow area and flow direction of the first plurality of inlet openings 258 is different than the flow area and flow direction of the second plurality of inlet openings 260. In this way, flow passing through the first plurality of inlet openings 258 has a lower pressure drop and has a larger radial velocity or momentum component towards the turbine wheel than flow passing through the second plurality of inlet openings 260, which has a higher pressure drop and a larger tangential velocity or momentum component relative to the turbine wheel.

As shown, each of the first plurality of inlet openings 258 is in fluid communication with the gas passage 236 shown on the left side of the illustration of FIG. 3. Each of the second plurality of inlet openings 260 is in fluid communication with the gas passage 236 shown on the right side of the illustration of FIG. 3. Although both the left and right gas passages 236 have substantially the same flow area, the inlet openings 258 permit the substantially unobstructed flow of gas therethrough, but the reduced flow opening of the second plurality of inlet openings 260—as compared to the first plurality of inlet openings 258—provides an asymmetrical flow restriction to gas passing through the gas passages 236. In the embodiment shown, and in further reference to FIG. 1, the turbine inlet 122 that is fluidly connected to the first exhaust conduit 108 is configured to be in fluid communication with the second plurality of inlet openings 260. The turbine inlet 124 that is fluidly connected to the second exhaust conduit 110 is correspondingly in fluid communication with the first plurality of inlet openings 258. Notwithstanding any flow diversion that may be selectively provided by the balance valve 116 (FIG. 1) between the two turbine inlets 122 and 124 during operation, the reduced flow area corresponding to the second plurality of inlet openings 260 in the turbine will provide an increased gas pressure in the first exhaust conduit 108 such that the flow of EGR gas may be augmented, as previously described.

The unique flow characteristics of the turbine 120 may be determined by the size, shape, and configuration of the nozzle ring 238 while other portions of the turbine may advantageously remain unaffected or, in the context of designing for multiple engine platforms, the remaining portions of the turbine may remain substantially common for various engines and engine applications. Accordingly, the specific symmetrical or asymmetrical flow characteristics of a turbine that is suited for a particular engine system may be determined by combining a turbine, which otherwise may be common for more than one engine, with a particular nozzle ring having a configuration that is specifically suited for that particular engine system.

The customization capability provided by a specialized nozzle ring in an otherwise common turbocharger assembly presents numerous advantages over known turbochargers. First, an engine or parts manufacturer may streamline its production by reducing the number of different turbochargers that are manufactured. In this way, waste, inventory, and costs may be reduced in the market for original and service parts. Moreover, parts may remain common even when other surrounding components and systems, such as the EGR system, undergo changes to keep up with changing performance demands. Even further, low production number engine applications, which may otherwise not have a specialized turbocharger manufactured to optimally suit them because of cost considerations, may now be more easily customized at a lower cost by incorporating a unique nozzle ring in an otherwise common turbocharger. These and other advantages may be realized by use of interchangeable rings for turbines as set forth herein.

Based on the foregoing, it should be appreciated that the nozzle rings may be tailored in numerous configurations to provide a desired flow restriction and flow characteristics for the turbocharger in which they are installed. It has been found that turbine efficiency prediction can be greatly improved when the flow asymmetry that is provided between the first and second pluralities of inlet openings 258 and 260 is maintained substantially consistent, or within 5%, for both supersonic and sub-sonic exhaust gas velocities passing through the nozzle ring 238. This is because supersonic and subsonic exhaust gas flows can pass through the turbine under many different engine operating conditions. An exhaust pulse, for example, may include exhaust speed gradients that are subsonic and supersonic. By balancing the flow asymmetry between supersonic and subsonic gas velocities, the performance of the turbine on engine may be better understood and approximated or estimated, for example, by use of modeling or other calculation methods.

Figure 7:
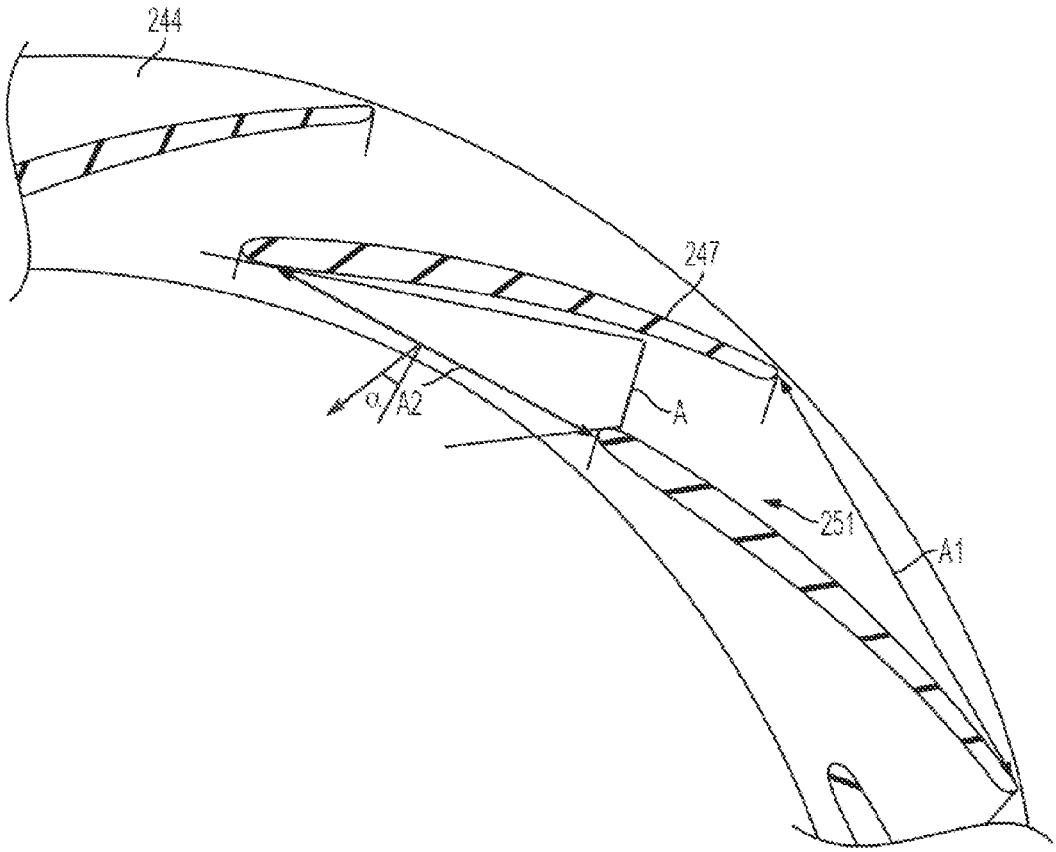
FIG. 7 is a cross section of a nozzle ring in accordance with the disclosure.

More specifically, the gas flow openings formed within the nozzle ring are effectively considered as two converging/diverging-type nozzles disposed in a parallel flow circuit configuration. A first such nozzle is formed collectively by the first plurality of inlet openings 258, and a second such nozzle is formed collectively by the second plurality of inlet openings 260. For purposes of discussion, each nozzle is modeled as a fluid passage having a mouth inlet opening area, $A_1$, which converges to a throat opening area, A. As shown in FIG. 7, which is an enlarged detail of FIG. 6, the inlet opening area $A_1$ is larger than the throat opening area A, which represents the smallest flow opening area of each flow passage formed between adjacent vanes. The flow opening area of each passage diverges from the throat opening area A to a larger, outlet opening area, $A_2$, in a generally inward radial direction with respect to the turbine shaft. The difference between the corresponding inlet, outlet and throat opening areas between the first and second pluralities of inlet openings 258 and 260 is proportionally different. In the illustrated embodiment, for a total flow area through the nozzle ring of 100%, the collective nozzle flow area through the first plurality of inlet openings 258 represents about 70% of the total flow area and, correspondingly, the collective nozzle flow area through the second plurality of inlet openings 260 represents the remaining 30% of the total flow area.

When exhaust gas flow through the nozzle ring is subsonic, if the static pressure at each outlet is assumed equal, flow distribution between the first plurality of inlet openings 258, which is designated by the subscript "70" to indicate that 70% of the total flow passes therethrough, and the second plurality of inlet openings 260, which is designated by the subscript "30" to indicate that 30% of the total flow passes there through, can be estimated in accordance with the following equation (Equation 1):

$$\frac{\dot{m}_{70}}{\dot{m}_{30}} = \frac{P_{t,70}}{P_{t,30}} \frac{A_{2,70}\cos(\alpha_{70})}{A_{2,30}\cos(\alpha_{30})} \sqrt{\frac{T_{t,30}}{T_{t,70}}} * f_1\left(\frac{P_{t,70}}{P_{t,30}}\right) \quad \text{Equation 1}$$

where m(dot) represents the respective mass flow rate of gas through the respective inlet openings, and $P_t$ represents gas pressure at the "total condition." The total condition is designated by the subscript "t" and is defined as the pressure (and density) when the flow is brought to rest isentropically. In Equation 1, $A_2$ represents the outlet opening area, $T_t$ represents gas temperature at the total condition, and $f$ represents a function. In the described emdodiment, $f$ is equal to 1 when the ratio of $P_{t,70}/P_{t,30}$ is equal to one, and $f$ increases with increasing $P_{t,70}/P_{t,30}$. The angle, $\alpha$, represents an angle between a vector normal to the area $A_2$ and the direction of the gas flux, i.e., the direction of gas flow, through $A_2$.

In the supersonic condition, a similar equation can be used to estimate the mass flow fraction between the two nozzles, as expressed in Equation 2, below:

$$\frac{\dot{m}_{70}}{\dot{m}_{30}} = \frac{P_{t,70}}{P_{t,30}} \frac{A_{70}}{A_{30}} \sqrt{\frac{T_{t,30}}{T_{t,70}}} * f_2\left(\frac{P_{t,70}}{P_{t,30}}\right) \quad \text{Equation 2}$$

where A is the throat area, as illustrated in FIG. 7, $f_2$ is a function of the ratio $P_{t,70}/P_{t,30}$, and $f_2$ is 1 for $P_{t,70}/P_{t,30}=1$ and increases with $P_{t,70}/P_{t,30}$.

For gas passages of equal area and different flow, there are increased flow losses incurred on the high-flow side. Thus, if the total pressure and total temperature are equal at some equally distant locations upstream of the plurality of inlet openings 258 and 260, such as 114 and 112, then the flow through the first plurality of inlet openings 258 will have lower total pressure than the second plurality of inlet openings 260. In this case, the total temperature at the first and second plurality of inlet openings 258 and 260 will be equal because no work occurs in the gas passages. Thus the following relations, which are expressed as Equations 3 and 4, are valid:

$$\frac{P_{t,70}}{P_{t,30}} f\left(\frac{P_{t,70}}{P_{t,30}}\right) \leq 1 \quad \text{Equation 3}$$

$$\sqrt{\frac{T_{t,30}}{T_{t,70}}} = 1 \quad \text{Equation 4}$$

In other words, the total pressure through the second plurality of inlet openings 260 will be higher or at least equal to the total pressure through the first plurality of inlet openings 258, which will cause the expression of Equation 3 to be less than or equal to one, and the total temperature is assumed to be the same, which will cause the ratio expressed in equation 4 to be equal to one. As a result, the mass flow ratio m(dot) between the two nozzles will be close but slightly less than the effective outlet opening area ratio.

With these relations in mind, appropriate inlet, outlet and throat opening areas, as well as diverging nozzle angles, for example, the angle $\alpha$, can be selected. Computational and gas-stand tests were performed on a nozzle ring having a first plurality of inlet openings throat opening (high flow) of about 940 $mm^2$ and a second plurality of inlet openings throat opening (low flow) of about 406 $mm^2$. Although testing and calculations were performed for subsonic conditions, on the basis of the above equations and relatioins, substantially the same flow asymmetry, for example, within 0.5% difference, is expected between subsonic and supersonic conditions. In the tested device, each vane in the first plurality of vanes has a profile in which an outer edge of the vane was disposed at an inlet angle, $\phi_1$, of about 68 degrees and an inner edge disposed at a discharge angle, $\theta_1$, of about 70 degrees, both with respect to the circular profile of the ring. Each vane in the second plurality of vanes has a profile in which an outer edge of the vane is disposed at an inlet angle, $\phi$2, of about 68.5 degrees and an inner edge disposed at a discharge angle, $\theta_2$, of about 79 degrees, all with respect to the circular profile of the ring, as shown in FIGS. 5 and 6.

Two aspects of the disclosed embodiments are noted. The first is that each nozzle outlet area, $A_2$, approximates each respective nozzle throat area A. In this way, consistent flow asymmetry between subsonic and supersonic operating conditions is achieved, which can improve engine performance predictability as previously described. Moreover, aerodynamic efficiency of the turbine wheel can be improved. By appropriately selecting similar areas for the $A_2$ and A flow cross sections, the exhaust flow passing therethrough diffuses less in the nozzle and is thus better conditioned for encountering adverse pressure gradients in the turbine wheel.

The second aspect of the disclosed embodiments noted is that the areas A2 and A are aligned along a direction with only a radial and tangential component with respect to the turbine wheel. In this way, an efficiency improvement can be realized due to alignment of the exhaust flow with the turbine wheel passage.

The efficiency benefits attributable to the two stated aspects of the disclosed embodiments have been verified by computational experiments in which the improved design described herein was compared with a baseline nozzle ring. The experiment indicated a 2% rotor efficiency improvement over the baseline nozzle for the example asymmetry discussed herein. This efficiency improvement may be slightly different for other symmetries Industrial Applicability The present disclosure is applicable to radial and mixed-flow turbines, especially those turbines used on turbocharged internal combustion engines. Although an engine 100 having a single turbocharger is shown (FIG. 1), any engine configuration having more than one turbocharger in series or in parallel arrangement is contemplated.

As is known, turbine performance depends in part on the available energy content or enthalpy per unit of gas driving the turbine. Additionally, turbine performance and efficiency can be increased improving the flow characteristics of exhaust gas provided to the turbine wheel. In the present disclosure, the substantial axial alignment of the divider wall extension portion 245 (FIG. 3) with the divider wall 240 of the turbine housing 215 advantageously reduces flow curvature and swirling in the exhaust gas flow passing from the turbine housing scrolled passages to the turbine wheel. It has been determined that with the embodiments presented herein, even though the flow of gas is asymmetric between the two nozzles of the ring, static pressure gradients across the ring are reduced, which in turn provides more uniform flow conditions for gas into the turbine wheel area of the housing.

It will be appreciated that the foregoing description provides examples of the disclosed system and technique. However, it is contemplated that other implementations of the disclosure may differ in detail from the foregoing examples, such as for example the asymmetry of the first and second plurality of inlet openings 258 and 260. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

We claim:

1. A nozzle ring adapted for installation into a receiving bore in a turbine housing, the turbine housing having two flow passages having the same flow area formed therewithin and separated by a divider wall, each flow passage being connected to a respective gas inlet, the receiving bore surrounding a turbine wheel when the turbine housing is assembled into a turbocharger, the nozzle ring comprising:

a first outer ring;

an inner ring disposed adjacent the first outer ring, said inner ring having an annular shape and disposed in axial alignment with the divider wall, a second outer ring disposed adjacent the inner ring, said second outer ring having a thicker cross section than the first outer ring;

a first plurality of vanes fixedly disposed between the first outer ring and the inner ring, the first plurality of vanes defining a first plurality of inlet openings therebetween that are in fluid communication with a slot formed in the nozzle ring and adapted to surround the turbine wheel;

a second plurality of vanes fixedly disposed between the second outer and the inner rings, the second plurality of vanes defining a second plurality of inlet openings therebetween that are in fluid communication with the slot;

wherein the first plurality of inlet openings collectively defines a first flow outlet area that is larger than a second flow outlet area collectively defined by the second plurality of inlet openings.

2. The nozzle ring of claim 1, wherein each of the first plurality of inlet openings defines a respective first throat area, which represents a minimum cross-sectional flow area of the respective first inlet opening, and a respective first outlet area, which is defined at a boundary between the respective first inlet opening and the slot;

wherein each respective first throat area is equal to each respective first outlet area;

wherein each of the second plurality of inlet openings defines a respective second throat area, which represents a minimum cross-sectional flow area of the respective second inlet opening, and a respective second outlet area, which is defined at a boundary between the respective second inlet opening and the slot; and wherein each respective second throat area is equal to each respective second outlet area.

3. The nozzle ring of claim 1, wherein the first plurality of inlet openings is functionally equal to a first nozzle of a converging/diverging type, the first nozzle having a first throat area and a first outlet area, and wherein the second plurality of inlet openings is functionally equal to a second nozzle of a converging/diverging type, the second nozzle having a second throat area and a second outlet area.

4. The nozzle ring of claim 1, wherein, when the nozzle ring is installed in the turbine housing and the turbocharger is operating, the nozzle ring operates to align a gas flow passing therethrough into a flow having only radial and tangential components with respect to the turbine wheel.

5. The nozzle ring of claim 1, wherein the thicker cross section of the second outer ring contributes to increasing efficiency of the turbocharger by being disposed in a flow path of exhaust gas passing through the nozzle ring so that a flow diffusion thereof is controlled before the exhaust gas reaches the turbine wheel.

6. A turbine, comprising:

a turbine housing including at least two gas passages having the same flow area and disposed on opposing sides of a divider wall;

a turbine wheel having a plurality of blades;

a nozzle ring connected to the turbine housing and disposed around the turbine wheel, the nozzle ring having:

a first outer ring, an inner ring disposed adjacent the first outer ring, said inner ring having an annular shape and disposed in axial alignment with the divider wall, a second outer ring disposed adjacent the inner ring, said second outer ring having a thicker cross section than the first outer ring;

a first plurality of vanes fixedly disposed between the first outer and the inner rings, the first plurality of vanes defining a first plurality of inlet openings therebetween that are in fluid communication with a slot formed in the nozzle ring and surrounding the turbine wheel;

a second plurality of vanes fixedly disposed between the second outer and the inner rings, the second plurality of vanes defining a second plurality of inlet openings therebetween that are in fluid communication with the slot;

wherein the first plurality of inlet openings collectively defines a first flow outlet area that is larger than a second flow outlet area collectively defined by the second plurality of inlet openings.

7. The turbine of claim 6, wherein each of the first plurality of inlet openings defines a respective first throat area, which represents a minimum cross-sectional flow area of the respective first inlet opening, and a respective first outlet area, which is defined at a boundary between the respective first inlet opening and the slot;

wherein each respective first throat area is equal to each respective first outlet area;

wherein each of the second plurality of inlet openings defines a respective second throat area, which represents a minimum cross-sectional flow area of the respective second inlet opening, and a respective second outlet area, which is defined at a boundary between the respective second inlet opening and the slot; and wherein each respective second throat area is equal to each respective second outlet area.

8. The turbine of claim 6, wherein, during operation, a first portion of exhaust gas flow entering the turbine housing passes through the first plurality of inlet openings and a second portion of exhaust flow entering the turbine housing passes through the second plurality of inlet openings, and wherein a variation of a ratio between the first and second portions of exhaust gas flow is less than 5% when a speed of the exhaust gas passing through the first and second pluralities of inlet openings changes from subsonic to supersonic and vice versa.

9. The turbine of claim 8, wherein the first flow outlet area is equal to a first nozzle of a converging/diverging type, the first nozzle having a first throat area and a first outlet area, and wherein the second flow outlet area is equal to a second nozzle of a converging/diverging type, the second nozzle having a second throat area and a second outlet area.

10. The turbine of claim 9, wherein the first portion of exhaust gas flow depends on a size of the first outlet area when the speed of the exhaust gas flow is subsonic and on a size of the first throat area when the speed of the exhaust gas flow is supersonic.

11. The turbine of claim 10, wherein the first throat area is 940 square millimeters, and wherein the second throat area is 406 square millimeters.

12. The turbine of claim 6, wherein each of the first and second pluralities of vanes includes 15 vanes.

13. The turbine of claim 6, further including a smooth protrusion connected to the second outer ring and extending peripherally around the second outer ring along a sidewall thereof facing the inner ring, such that the smooth protrusion is disposed within and encroaches into a cross sectional flow area between the inner ring and the second outer ring.

14. The turbine of claim 6, wherein the nozzle ring is disposed within a bore formed in the turbine housing, and wherein the turbine further includes a retainer disposed to retain the nozzle ring within the bore of the housing, the retainer extending peripherally around the nozzle ring and connected to the housing by fasteners.

15. An internal combustion engine, comprising:

a divided turbine having first and second inlets;

a first plurality of cylinders connected to a first exhaust conduit, the first exhaust conduit being connected to the first inlet of the divided turbine;

a second plurality of cylinders connected to a second exhaust conduit, the second exhaust conduit being connected to the second inlet of the divided turbine;

a balance valve disposed to selectively route exhaust gas from the first exhaust conduit to the second exhaust conduit;

an exhaust gas recirculation (EGR) system including a valve that selectively fluidly connects the first exhaust conduit with an intake system of the engine;

wherein the divided turbine includes:

a turbine housing including two gas passages having the same flow area and disposed on opposing sides of a divider wall, the two gas passages being fluidly connected to the first and second inlets of the divided turbine;

a turbine wheel having a plurality of blades;

a nozzle ring connected to the turbine housing and disposed around the turbine wheel, the nozzle ring having:

a first outer ring, an inner ring disposed adjacent the first outer ring, said inner ring having an annular shape and disposed in axial alignment with the divider wall, a second outer ring disposed adjacent the inner ring, said second outer ring having a thicker cross section than the first outer ring;

a first plurality of vanes fixedly disposed between the first outer and the inner rings, the first plurality of vanes defining a first plurality of inlet openings therebetween that are in fluid communication with a slot formed in the nozzle ring and surrounding the turbine wheel;

a second plurality of vanes fixedly disposed between the second outer and the inner rings, the second plurality of vanes defining a second plurality of inlet openings therebetween that are in fluid communication with the slot;

wherein the first plurality of inlet openings collectively defines a first flow outlet area that is larger than a second flow outlet area collectively defined by the second plurality of inlet openings.

16. The internal combustion engine of claim 15, wherein each of the first plurality of inlet openings defines a respective first throat area, which represents a minimum cross-sectional flow area of the respective first inlet opening, and a respective first outlet area, which is defined at a boundary between the respective first inlet opening and the slot;

wherein each respective first throat area is equal to each respective first outlet area;

wherein each of the second plurality of inlet openings defines a respective second throat area, which represents a minimum cross-sectional flow area of the respective second inlet opening, and a respective second outlet area, which is defined at a boundary between the respective second inlet opening and the slot; and wherein each respective second throat area is equal to each respective second outlet area.

17. The internal combustion engine of claim 15, wherein, during operation, a first portion of exhaust gas flow entering the turbine housing passes through the first plurality of inlet openings and a second portion of exhaust gas flow entering the turbine housing passes through the second plurality of inlet openings, and wherein a variation of a ratio between the first and second portions of exhaust gas flow is less than 5% when a speed of the exhaust gas passing through the first and second pluralities of inlet openings changes from subsonic to supersonic and vice versa.

18. The internal combustion engine of claim 17, wherein the first flow outlet area is equal to a first nozzle of a converging/diverging type, the first nozzle having a first throat area and a first outlet area, and wherein the second flow outlet area is equal to a second nozzle of a converging/diverging type, the second nozzle having a second throat area and a second outlet area.

19. The internal combustion engine of claim 18, wherein the first portion depends on a size of the first outlet area when the speed of the exhaust gas is subsonic and on a size of the of the first throat area when the speed of the exhaust gas is supersonic.

20. The internal combustion engine of claim 19, wherein the first throat area is 940 square millimeters, and wherein the second throat area is 406 square millimeters.

21. The internal combustion engine of claim 15, wherein each of the first and second pluralities of vanes includes 15 vanes.

22. The internal combustion engine of claim 15, further including a smooth protrusion connected to the second outer ring and extending peripherally around the second outer ring along a sidewall thereof facing the inner ring, such that the smooth protrusion is disposed within and encroaches into a cross sectional flow area between the inner ring and the second outer ring.

23. The internal combustion engine of claim 15, wherein the nozzle ring is disposed within a bore formed in the turbine housing, and wherein the turbine further includes a retainer disposed to retain the nozzle ring within the bore of the housing, the retainer extending peripherally around the nozzle ring and connected to the housing by fasteners.

* * * * *